US011004307B2

(12) United States Patent
Oyama et al.

(10) Patent No.: US 11,004,307 B2
(45) Date of Patent: May 11, 2021

(54) INFORMATION PROCESSOR

(71) Applicant: Universal Entertainment Corporation, Tokyo (JP)

(72) Inventors: Masaki Oyama, Tokyo (JP); Toshikazu Jinnouchi, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 16/553,872

(22) Filed: Aug. 28, 2019

(65) Prior Publication Data

US 2020/0082669 A1 Mar. 12, 2020

(30) Foreign Application Priority Data

Sep. 6, 2018 (JP) ..... JP2018-166604

(51) Int. Cl.
*G07F 17/34* (2006.01)
*G07F 17/32* (2006.01)

(52) U.S. Cl.
CPC ..... *G07F 17/3262* (2013.01); *G07F 17/3209* (2013.01); *G07F 17/3258* (2013.01); *G07F 17/34* (2013.01)

(58) Field of Classification Search
CPC .. G07F 17/34; G07F 17/3262; G07F 17/3209; G07F 17/3258
See application file for complete search history.

(56) References Cited

U.S. PATENT DOCUMENTS 9,272,213 B2 3/2016 Toyama
2008/0045297 A1* 2/2008 Okada ..... G07F 17/3267 463/17
2009/0156294 A1* 6/2009 Berkowitz ..... G07F 17/3244 463/20
2012/0309490 A1* 12/2012 Okada ..... G07F 17/3244 463/20
2015/0339883 A1* 11/2015 Munakata ..... G07F 17/3244 463/18

* cited by examiner

*Primary Examiner* — Omkar A Deodhar
*Assistant Examiner* — Shauna-Kay Hall
(74) *Attorney, Agent, or Firm* — Simpson & Simpson, PLLC; S. Peter Konzel

(57) ABSTRACT

The information processor executes the processes of: (a) accepting a bet amount by a betting device; (b) executing random determination based on the bet amount accepted in the process (a); (c) when there is a payout as a result of the random determination in the process (b), calculating the ratio of the payout to the bet amount; (d) determining whether the ratio calculated in the process (c) falls within a predetermined range; (e) when the ratio falls within the predetermined range in the process (d), awarding the payout and terminating the unit game; and (f) when the ratio does not fall within the predetermined range in the process (d) or when there is no payout in the process (b), executing the processes (b) to (e) again.

14 Claims, 13 Drawing Sheets

FIG.6

SYMBOL ARRAYS OF VIDEO REELS

| | REEL 1 | REEL 2 | REEL 3 | REEL 4 | REEL 5 |
|---|---|---|---|---|---|
| 0 | HEART | 9 | CHERRY | 9 | KING |
| 1 | CHERRY | JACK | KING | JACK | ACE |
| 2 | 7 | HEART | 9 | WILD | BELL |
| 3 | JACK | 7 | ACE | 9 | KING |
| 4 | KING | 10 | BELL | JACK | WATERMELON |
| 5 | WATERMELON | 9 | 10 | HEART | WATERMELON |
| 6 | 10 | ACE | WATERMELON | KING | QUEEN |
| 7 | BELL | BELL | 10 | JACK | HEART |
| 8 | JACK | JACK | CHERRY | 10 | JACK |
| 9 | 9 | WATERMELON | 10 | BELL | 9 |
| 10 | ACE | 9 | WATERMELON | 9 | CHERRY |
| 11 | JACK | CHERRY | JACK | ACE | 10 |
| 12 | ACE | ACE | KING | ACE | 7 |
| 13 | BELL | QUEEN | HEART | 9 | ACE |
| 14 | KING | 9 | 7 | QUEEN | JACK |
| 15 | QUEEN | KING | 10 | 7 | 9 |
| 16 | HEART | WILD | 7 | CHERRY | KING |
| 17 | JACK | ACE | QUEEN | HEART | JACK |
| 18 | 10 | QUEEN | 10 | ACE | ACE |
| 19 | 9 | WATERMELON | WILD | KING | BELL |
| 20 | 9 | 10 | QUEEN | WATERMELON | QUEEN |
| 21 | CHERRY | 9 | 10 | 10 | ACE |
| 22 | JACK | QUEEN | CHERRY | BELL | 9 |
| 23 | 10 | CHERRY | ACE | 9 | WATERMELON |
| 24 | WATERMELON | ACE | QUEEN | 10 | 10 |
| 25 | JACK | 9 | QUEEN | CHERRY | ACE |
| 26 | | 7 | BELL | KING | CHERRY |
| 27 | | 10 | 9 | | QUEEN |
| 28 | | BELL | | | ACE |
| 29 | | | | | HEART |
| 30 | | | | | 10 |
| 31 | | | | | BELL |
| 32 | | | | | ACE |
| 33 | | | | | KING |
| 34 | | | | | |

FIG.7

SYMBOL COMBINATION TABLE

| SYMBOL | GRAPHICS | 1 | 2 | 3 | 4 | 5 |
|---|---|---|---|---|---|---|
| WILD | | 0 | 0 | 0 | 0 | 0 |
| 7 | | 0 | 0 | 50 | 300 | 1000 |
| HEART | | 0 | 0 | 35 | 200 | 800 |
| BELL | | 0 | 0 | 30 | 100 | 500 |
| WATERMELON | | 0 | 0 | 20 | 50 | 300 |
| CHERRY | | 0 | 0 | 15 | 35 | 300 |
| ACE | A | 0 | 0 | 10 | 30 | 200 |
| KING | K | 0 | 0 | 10 | 20 | 200 |
| QUEEN | Q | 0 | 0 | 10 | 15 | 100 |
| JACK | J | 0 | 0 | 10 | 15 | 100 |
| TEN | 10 | 0 | 0 | 5 | 15 | 100 |
| NINE | 9 | 0 | 0 | 5 | 10 | 100 |

INFORMATION PROCESSOR

CROSS-REFERENCE TO RELATED APPLICATION

This application claims the benefit of Japanese Patent Application No. 2018-166604 filed on Sep. 6, 2018, which application is incorporated herein by reference in its entirety.

FIELD OF THE INVENTION

The present invention relates to an information processor.

BACKGROUND OF THE INVENTION

Typically, in a smartphone (information processor) in which game application software is installed, a social game, etc., random determinations are performed in response to a player's operation of a touch panel of a smartphone, and a game advances based on random determination results. In such a game, the game may shift to a different special game when a predetermined condition is satisfied in the advancement of the normal game. The predetermined condition is satisfied, for example, when an item which influences on the advancement of the game is exchanged with a monetary value deposited in the game through the purchase of a prepaid card, is exchanged with a monetary value obtained by paying money, or is obtained in random determination in the game (Patent Literature 1 (U.S. Pat. No. 9,272,213)).

When the shift to the special game occurs in the advancement of the game, the probability of obtaining a specific benefit or a payout by random determination may be (e.g., 3 times or 5 times) higher than the probability of obtaining the specific benefit or payout by random determination in the normal game.

BRIEF SUMMARY OF THE INVENTION

However, when the winning probability of the specific bet amount or payout is different after the shift to the special game as described above, the payout may be excessively large depending on a bet amount or the type of the specific benefit, and this may be disadvantageous for the game provider.

An object of the present disclosure is therefore to provide an information processor in which disadvantage on a game provider after the shift to a game in which the probability of awarding a payout by random determination is high is reduced.

In the present disclosure, an information processor which executes a unit game involved with random determination, includes: a betting device configured to accept a bet amount required to execute the unit game; and a controller which is programmed to execute the processes of: (a) accepting the bet amount by the betting device; (b) executing the random determination based on the bet amount accepted in the process (a); (c) when there is a payout as a result of the random determination in the process (b), calculating the ratio of the payout to the bet amount; (d) determining whether the ratio calculated in the process (c) falls within a predetermined range; (e) when the ratio falls within the predetermined range in the process (d), awarding the payout and terminating the unit game; and (f) when the ratio does not fall within the predetermined range in the process (d) or when there is no payout in the process (b), executing the processes (b) to (e) again.

According to the arrangement above, a payout is awarded when the ratio of the payout to the bet amount falls within the predetermined range. Meanwhile, when the ratio does not fall within the predetermined range or there is no payout, the process is executed again from the random determination. With this arrangement, while the probability of awarding a payout is increased by executing the random determination again, a payout is awarded only when the ratio of the payout to the bet amount falls within the predetermined range. For this reason, the payout amount to be awarded does not become excessively large, with the result that disadvantage on the game provider is reduced.

In the present disclosure, the information processor is arranged so that the controller is configured to further execute the process (f) when a predetermined condition is satisfied.

According to the arrangement above, the random determination is executed again under a predetermined condition (e.g., the use of an item with which the probability of obtaining a payout is increased, a bonus game, or payment). On this account, the payout rates of the entire game are easily adjustable even in the game state advantageous for the player.

In the present disclosure, the information processor is arranged so that, when a payout with which the ratio falls within the predetermined range is not awarded as a result of the process (f) and there is a payout corresponding to the random determination in the process (b), the controller awards the payout corresponding to the result of the random determination in the process (b).

When a payout does not fall within the predetermined range even after the execution of the random determination again, the player cannot receive a payout even though a payout is resulted from the random determination. As the initial payout is awarded to the player, it is possible to avoid excessive disadvantage for the player.

An information processor in which disadvantage on a game provider after the shift to a game in which the probability of awarding a payout by random determination is high is reduced can be provided.

BRIEF DESCRIPTION OF THE DRAWINGS

FIG. 6 illustrates symbol arrays of video reels in the slot game.

FIG. 7 illustrates a symbol combination table of the slot game.

DETAILED DESCRIPTION OF THE PREFERRED EMBODIMENT

Embodiment

An information processor of the present embodiment will be described with reference to figures.

A game executed in the present embodiment is installed in and executed by an information processor, as application software (program and game data). Examples of the information processor include mobile information devices such as a smartphone, a portable computer, a laptop computer, a note PC, a tablet PC, a handheld PC, and a PDA (Personal Data Assistant). The application software by which the game is executed is downloaded from a server or the like via communication means (see FIG. 2) and stored in a storage device (e.g., a flash memory 104) in the information processor. The communication means may be an interactive communication passage such as the Internet and a cable TV, or may be one-way broadcasting.

The application software by which the game is executed may be stored in a recording medium such as a CD-ROM, a DVD-ROM, an MO (optical magnetic disc), and a flash memory, and may be read from the recording medium and installed in a storage device of the information processor, according to need.

Figure 1:
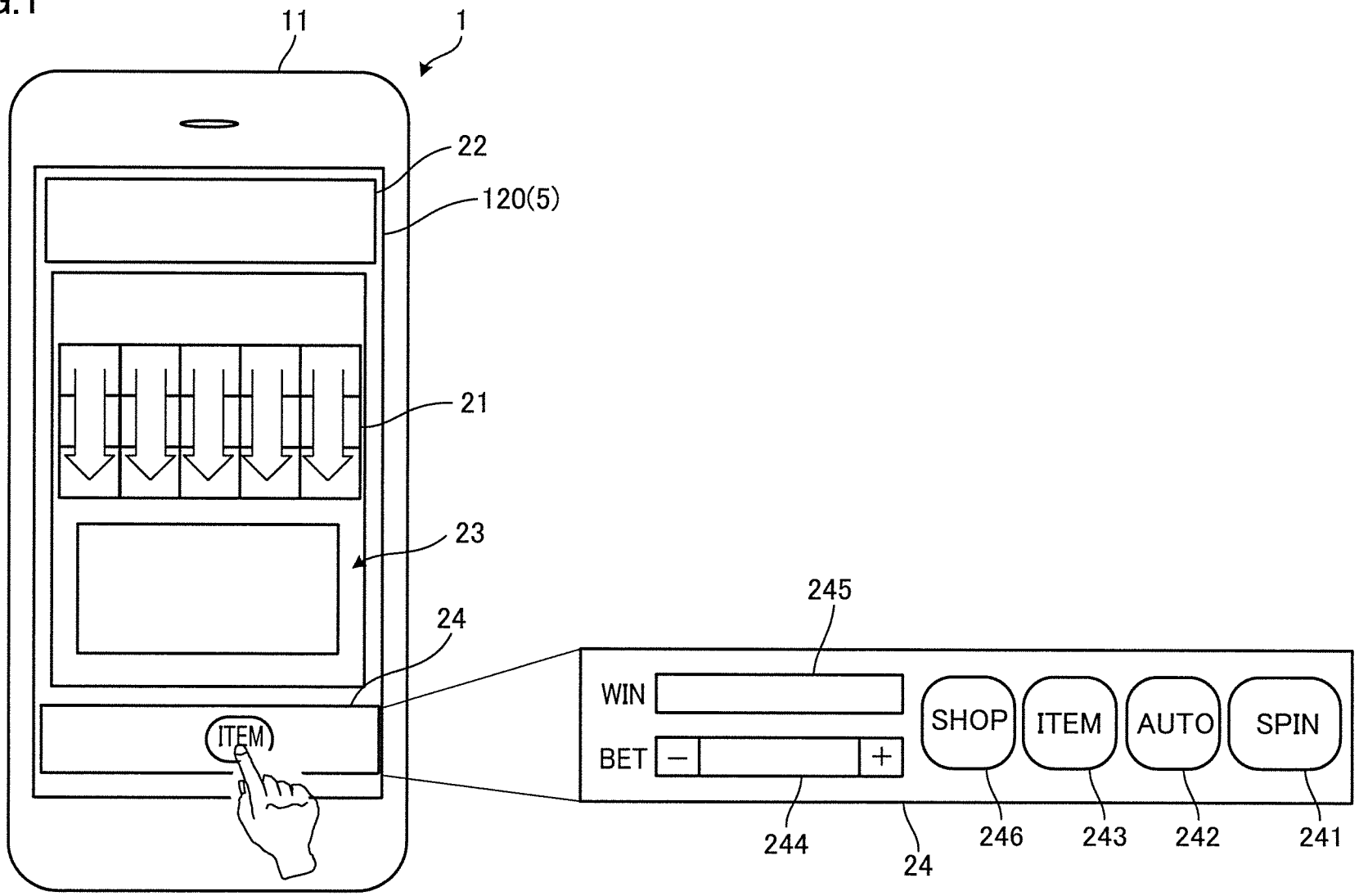
FIG. 1 illustrates a display state of a smartphone (information processor).

In the present embodiment, a smartphone 1 shown in FIG. 1 is taken as an example of the information processor. While the descriptions below deal with the smartphone 1, processes and operations of the smartphone 1 can be interpreted as those of a program or a game control method.

The game may be embodied as a social game. To be more specific, the application software of the game may be executed on a web browser provided by a server, and the game may be run in such a way that a mobile information device such as a smartphone accesses to the web browser provided by the server. In this case, the server, or a combination of the server and the mobile information device such as a smartphone which accesses to the server is equivalent to the information processor of the present invention.

Online

Figure 2:
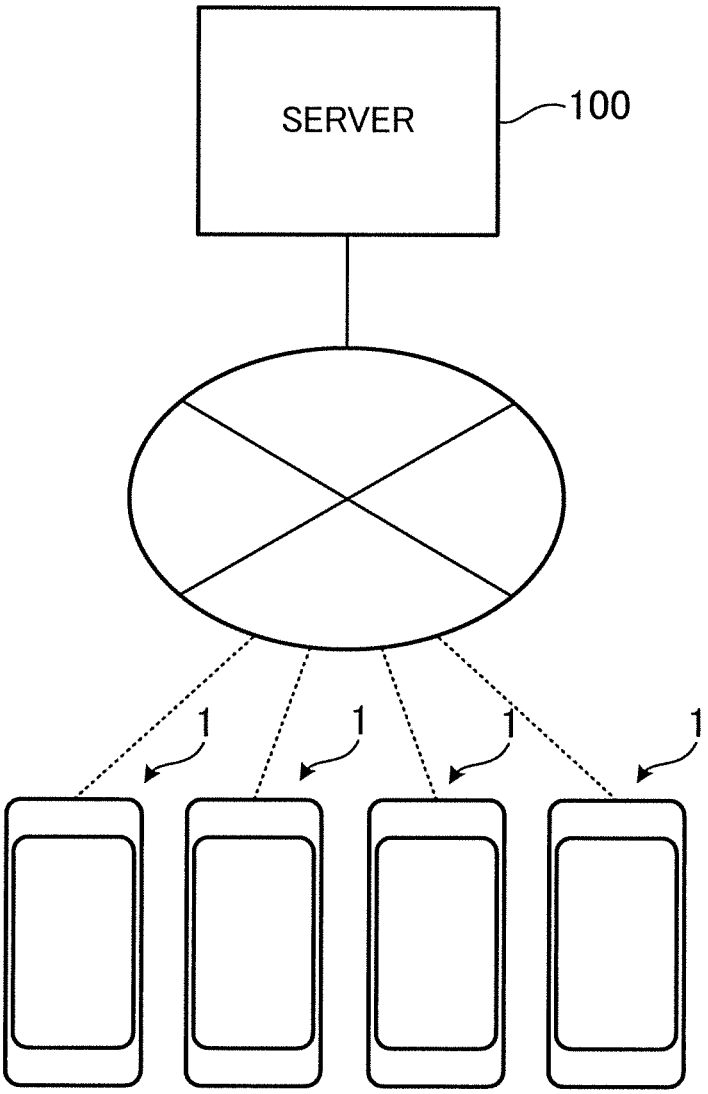
FIG. 2 shows a network environment between the smartphone and a server.

The game of the present embodiment is a slot game and is run as an online game. To be more specific, as shown in FIG. 2, the server 100 managed by an administration organization of the slot game is connected to smartphones 1 of many players over a computer network (Internet).

In this way, the slot game is run online. A player is able to download the application software of the slot game from the server 100, install it in the smartphone 1, and run the slot game. The server 100 (management system) is configured to exchange credits (which can be bought by cash, a credit card, electronic money, a prepaid card, etc.) owned by players to coins (gaming media) which are electronic information usable in the slot game, and to manage the coins owned by the players.

Structure of Smartphone 1

Figure 3:
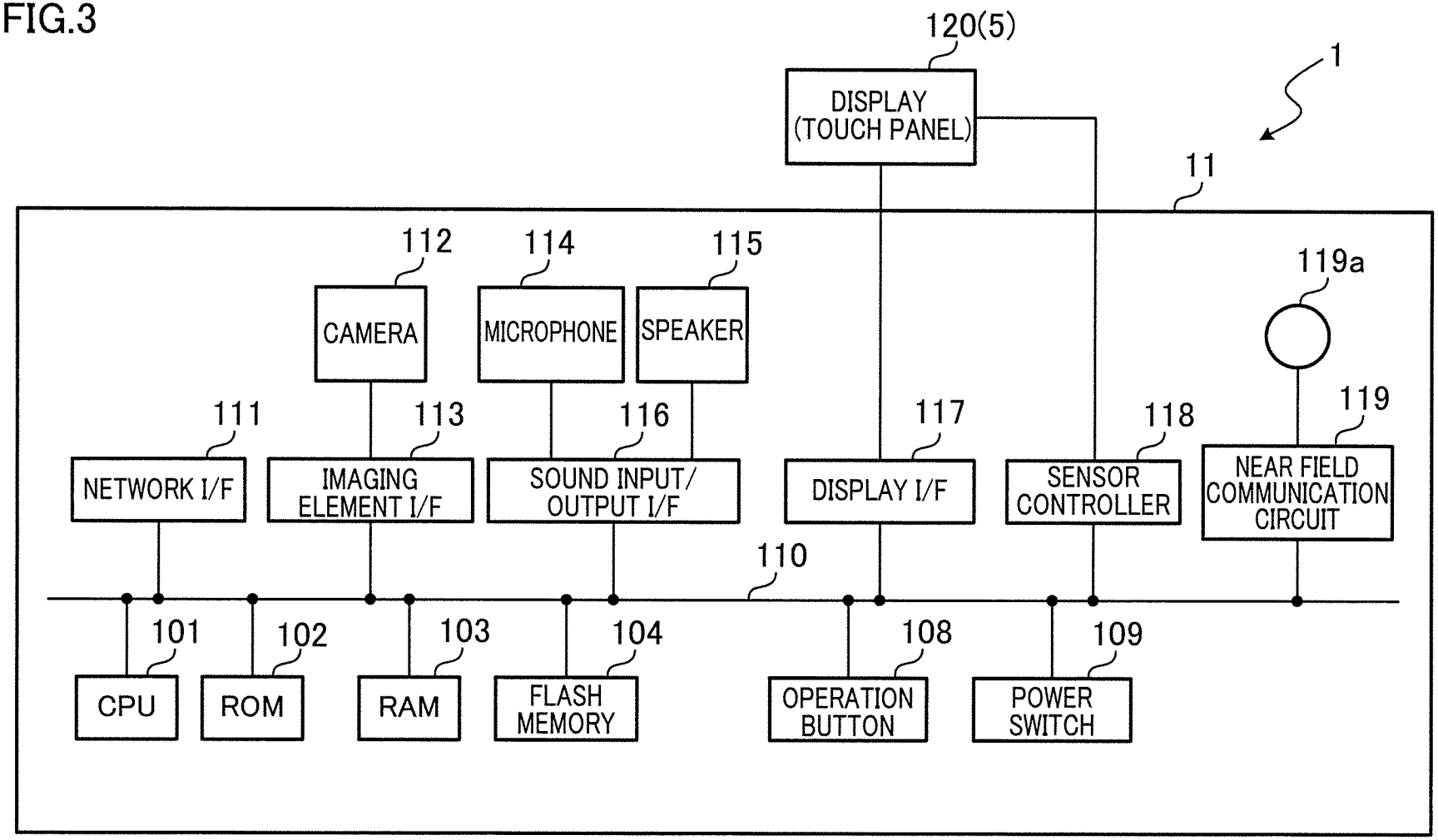
FIG. 3 is a block diagram of the electrical configuration of the smartphone (information processor).

As shown in FIG. 3, the smartphone 1 includes, in a housing 11, a CPU 101 (controller), a ROM 102, a RAM 103, a flash memory 104, an operation button 108, a power switch 109, a bus line 110, a network I/F 111, a camera 112, an imaging element I/F 113, a microphone 114, a speaker 115, a sound input/output I/F 116, a display I/F 117, a sensor controller 118, a near field communication circuit 119, and an antenna 119*a* of the near field communication circuit 119. In the front surface of the housing 11, a display 120 with a touch panel 5 (input unit) is embedded.

The display 120 is configured to be able to display images. The display method of the display 120 is, for example, liquid crystal, organic electroluminescence, CRT (Cathode Ray Tube), or plasma.

The CPU (Central Processing Unit) 101 controls the entire smartphone 1. The ROM (Read Only Memory) 102 stores programs used for driving the CPU 101, such as an IPL (Initial Program Loader).

The RAM (Random Access Memory) 103 is used as a work area of the CPU 101. The flash memory 104 stores application software (program) for running the game of the present embodiment, a communication program, and data such as image data and sound data (e.g., symbol arrays of later-described video reels, game data required by a symbol combination table and the slot game, and the number of owned coins). The operation button 108 is used for, for example, initial setting of the smartphone 1. The power switch 109 is used for turning on/off the power source of the smartphone 1.

The network I/F (Interface) 111 is an interface for performing data communication with the server 100, etc., by utilizing a communication network such as the Internet. The camera 112 is a built-in camera image capturing means which captures an image of an object to obtain image data under the control of the CPU 101. The imaging element I/F 113 is a circuit for controlling the camera 112. The microphone 114 is a built-in sound collection means to which sound is input. The sound input/output I/F 116 is a circuit for processing input and output of a sound signal between the microphone 114 and the speaker 115 under the control of the CPU 101. The display I/F 117 is a circuit for sending image data to the display 120 under the control of the CPU 101. The sensor controller 118 is a circuit for receiving an input from the touch panel 5 of the display 120. The near field communication circuit 119 is a communication circuit based on NFC (Near Field Communication) (Registered Trademark). Bluetooth (Registered Trademark), or the like. The bus line 110 is an address bus, a data bus, or the like for electrically connecting the components such as the CPU 101.

Outline of Slot Game Executed by Smartphone 1

In the smartphone 1 arranged as described above, the CPU 101 executes the application software of the slot game based on the program.

When the application software of the slot game is executed in the smartphone 1, images such as game start effect images are displayed. Thereafter, the slot game starts upon selection of a selection image indicating the start of the slot game on the touch panel 5 (detailed later). For example, as shown in FIG. 1, when the slot game starts, the slot game in which symbols are rearranged in a symbol display area 21 which is formed of 15 areas forming a matrix with 5 columns and 3 rows is executed (details will be given later).

There may be plural selectable slot games, and the rule, the state of payout, and effect images may be different depending on which slot game is executed. For example, in a slot game of one type, symbols are rearranged in a symbol display area formed of 9 areas forming a matrix with 3 columns and 3 rows. In this slot game, whether a win is achieved is determined based on a combination of symbols rearranged on a payline set only at the middle stage of the symbol display area (winning determination).

The slot game of the present embodiment is basically started in response to the consumption of a predetermined amount of coins (gaming media) owned by a player. When a predetermined condition is satisfied, the player is able to start the slot game without the consumption of coins. (The predetermined condition is, for example, a condition of awarding a free game or the slot game is playable without the consumption of coins for a predetermined number of times in a day.)

The coins (gaming media) owned by players are electronic information. A player accesses the server 100 via the smartphone 1 and exchanges credits to coins in accordance with a payment method specified by the management organization of the slot game. The coins owned by players are used in various ways. For example, the coins are consumed to obtain an effect influencing on the slot game (as purchase of items), or consumed to change the appearance of an avatar of a player.

The number of coins owned by each player, which is managed by the server 100, is shared between the server 100 and each smartphone 1 by communication. The flash memory 104 of the smartphone 1 stores the number of coins owned by the player, which is shared with the server 100.

The gaming medium is not limited. For example, when the slot game of the present embodiment is run on a gaming machine (slot machine) installed in a hall or the like, the gaming medium may be a medal, a token, electronic money, a ticket, etc. The ticket is not particularly limited, and a barcoded ticket may be adopted for example. Alternatively, the gaming medium may be a game point not including valuable information.

Slot Game: Definitions

The slot game executed in the present embodiment is a game in which symbols are varied in the symbol display area 21 (scrolling image of reels) and then stopped (rearranged), and a benefit (e.g., a payout or an item advantageous or disadvantageous for the player) is awarded based on the combination of the symbols displayed in the symbol display area 21. A state in which symbols are displayed after being varied and stopped in the symbol display area 21 is termed "rearrangement".

A payout awarded based on a combination of symbols displayed in the symbol display area 21 is awarding of coins.

The "unit game" is a series of operations from the start of the receiving of a bet to the establishment of a prize (i.e., a combination of symbols satisfies a predetermined relation). To put it differently, the unit game includes a single bet time for receiving a bet, a single game time of rearranging stopped symbols, and a single payout time of a payout process of awarding a payout.

Slot Game Screen

A slot game screen displayed on the display 120 of the smartphone 1 will be described.

As shown in FIG. 1, when the slot game is executed, the slot game screen is displayed on the display 120. The slot game screen displays the symbol display area 21 formed of 15 areas forming a matrix with 5 columns and 3 rows, a game information display area 22 on which information of increment and decrement in accordance with the execution of the slot game (e.g., the number of currently-owned coins) is displayed, an effect display area 23 on which moving and still images and messages related to the game are displayed in accordance with the progress of the slot game, and an operation display area 24 which is operated by the player to progress the slot game. The operation display area 24 includes a spin button 241, an AUTO button 242, an ITEM button 243, a bet button 244, a WIN display portion 245, and a shop button 246.

On the entire surface of the display 120, a touch panel 5 which allows the slot game screen to be viewable from the outside is provided. The touch panel 5 makes it possible to detect the coordinates of a part touched by a player's finger or the like. With this arrangement, for example, the slot game (unit game) is executed once, upon a touch input of the image of the spin button 241. Furthermore, the slot game is serially executed plural times as the image of the AUTO button 242 is pressed. When the image of the ITEM button 243 is pressed, the player is able to select and use a previously-obtained item (which exerts an influence in the slot game). When the image of the shop button 246 is touched, the smartphone 1 accesses the server 100 and the player enters a shop in which credits (which can be bought by cash, a credit card, electronic money, a prepaid card, etc. owned by the player) are exchangeable with coins, or credits or coins are exchangeable with an item.

Symbol Display Area 21

Figure 4:
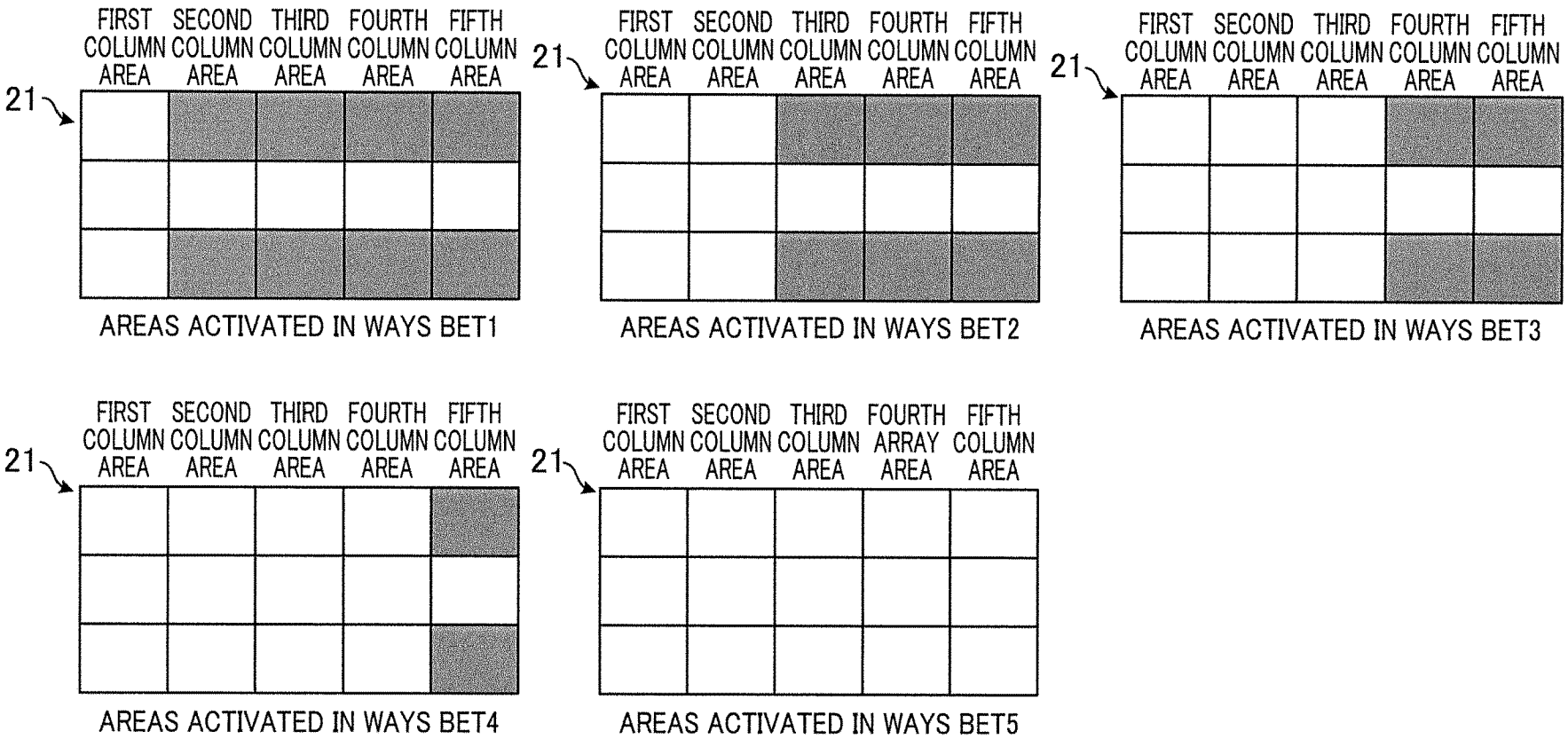
FIG. 4 illustrates active areas of "WAYS BET" in a slot game.
Figure 5:
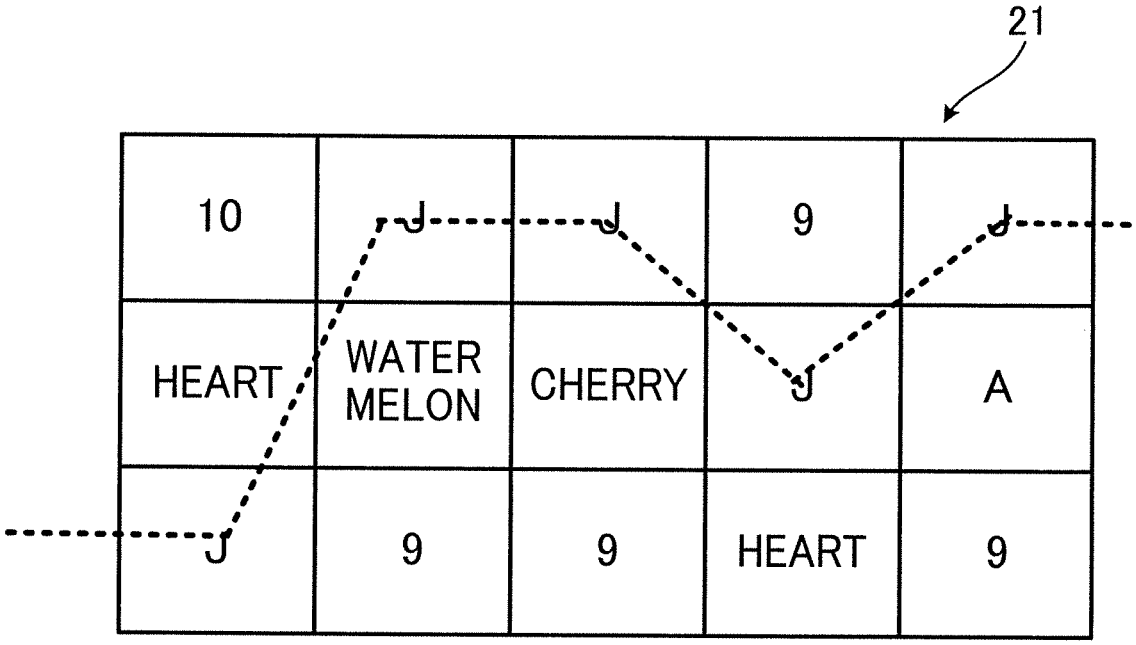
FIG. 5 illustrates an example of result determination of "WAYS BET" in the slot game.

The symbol display area 21 of the slot game includes five column areas (first column area to fifth column area) each of which is divided into three areas: the upper stage, the middle stage, and the lower stage, as shown in FIG. 4 and FIG. 5. In the first column area to the fifth column area, five video reels 3 (REEL1, REEL2, REEL3, REEL4, and REEL5) are displayed, respectively. On the video reels 3 of the slot game of the present embodiment, the rotation and stop of mechanical reels having circumferential surfaces on which symbols are depicted are expressed by video. To each of the video reels 3 (REEL1, REEL2, REEL3, REEL4, and REEL5), a symbol array each constituted by plural symbols is allocated (see FIG. 6).

In the symbol display area 21, the symbol array allocated to each of the video reels 3 (REEL1, REEL2, REEL3, REEL4, and REEL5) scrolls and stops after elapse of a predetermined time. As a result, parts of each symbol array (three successive symbols) are displayed in the symbol display area 21 one by one. In each of the first column area to the fifth column area of the symbol display area 21, one symbol is displayed in each of the three areas, i.e., the upper stage, the middle stage, and the lower stage, according to the corresponding video reel 3 (REEL1, REEL2, REEL3, REEL4, and REEL5). To put it differently, 15 symbols forming a 5 by 3 matrix are displayed in the symbol display area 21.

As described above, in the symbol display area 21, 15 areas are provided to form a matrix in such a way that five column areas (columns) and three stages (stages) which are the upper stage, the middle stage, and the lower stage intersect with one another.

In the slot game, "LEFT TO RIGHT" type is adopted for determining a win. That is, to begin with, by selecting one of five stages of WAYS BET (WAYS BET1, WAYS BET2, WAYS BET3, WAYS BET4, and WAYS BET5), areas to be subjected to result determination are selected out of 15 areas (the 5 by 3 matrix) of the symbol display area 21 (determination of active areas) (see FIG. 4). Then a win occurs when a predetermined number of symbols stopped in the result determination areas of the first column area to the fifth column area, which areas are subjected to result determination, are linked (see FIG. 5).

The selection of the five stages of WAYS BET (WAYS BET1, WAYS BET2, WAYS BET3, WAYS BET4, and WAYS BET5) is done by a touch input to the "+" or "−" button (see FIG. 1) of the bet button 244 (equivalent to a betting device). 2 coins are required to select the WAYS BET1. 3 coins are required to select the WAYS BET2. 7 coins are required to select the WAYS BET3. 15 coins are required to select the WAYS BET4. 25 coins are required to select the WAYS BET5.

Specifically, as shown in FIG. 4, when "WAYS BET1" is selected, the areas out of the symbol display area 21 subjected to result determination (areas activated) are: the upper stage, the middle stage, and the lower stage of the first column area; the middle stage of the second column area; the middle stage of the third column area; the middle stage of the fourth column area; and the middle stage of the fifth column area. Further, when "WAYS BET2" is selected, the areas out of the symbol display area 21 subjected to result determination (areas activated) are: the upper stage, the middle stage, and the lower stage of the first column area; the upper stage, the middle stage, and the lower stage of the second column area; the middle stage of the third column area; the middle stage of the fourth column area; and the middle stage of the fifth column area. Further, when "WAYS BET3" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. Further, when "WAYS BET4" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the upper stage, the middle stage, and the lower stage of the fourth column area; and the middle stage of the fifth column area. Further, when "WAYS BET5" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the upper stage, the middle stage, and the lower stage of the fourth column area; and the upper stage, the middle stage, and the lower stage of the fifth column area.

For example, as shown in FIG. 5, when the "WAYS BET5" is selected, all the areas out of the symbol display area 21 are subjected to result determination (activated). As shown in FIG. 5, when "J: Jack" symbols stop in the lower stage of the first column area, the upper stage of the second column area, the upper stage of the third column area, the middle stage of the fourth column area, and the upper stage of the fifth column area, there is a single win in which the five symbols are successively linked from the first column area to the fifth column area (LEFT TO RIGHT). As such, in the "LEFT TO RIGHT" type, the symbols may appear to be scattered at the first sight; however, if they are successively linked throughout the first column area to the fifth column area, it is determined as a win. Although the slot game of the present embodiment adopts the "LEFT TO RIGHT" type, it is possible to adopt a line type which regards as a winning line only a line connecting the middle stages of the column areas of the respective arrays. Alternatively, the slot game may adopt a scatter type in which whether a win is achieved is determined based on the number of symbols of the same type displayed in the symbol display area 21.

Symbol Arrays of Video Reels

Now, with reference to FIG. 6, the following describes a configuration of the symbol arrays on the video reels 3 of the slot game.

As shown in FIG. 6, to each of "REEL1", "REEL2", "REEL3", "REEL4", and "REEL5" of the video reels 3, a symbol array formed of symbols corresponding to code numbers 0 to 33 is allocated. The types of the symbols arranged on the symbol arrays of the video reels 3 include normal symbols such as "7", "HEART", "BELL", "WATERMELON", "CHERRY", "ACE(A)", "KING(K)", "QUEEN(Q)", "JACK(J)", "10", and "9" and a "WILD" symbol which is an almighty symbol that can substitute for any other symbol.

Symbol Combination Table

Now, a symbol combination table will be described with reference to FIG. 7. FIG. 7 shows a symbol combination table used in the slot game of the present embodiment.

The symbol combination table of the slot game defines the combinations of symbols (the number of symbols) with which a win is achieved and payout amounts of coins paid out (payout). In the slot game, a win is achieved when the scroll of the symbol arrays of the video reels 3 is stopped and a predetermined number of symbols of a predetermined type are linked in the areas in the symbol display area 21, which are subjects of result determination in the WAYS BET described above, from the first column area to the fifth column area. In accordance with the type of win, a benefit will be given to the player in the form of awarding a payout and the like.

Basically, a win is achieved when a predetermined number of symbols of a single type are arranged and linked to one another, as in three-symbols (3Kind), four-symbols (4Kind), or five-symbols (5Kind) combination, through the first column area to the fifth column area, within the winning determination areas set as the subject to winning determination, by the WAYS BET described above. The above symbols of the single type are "7", "HEART", "BELL", "WATERMELON", "CHERRY", "A", "K", "Q", "J", "10", and "9". It should be noted that, for the "WILD" symbol, any of the following types of symbols is substituted: "7", "HEART", "BELL", "WATERMELON", "CHERRY", "A", "K", "Q", "J", "10", and "9".

For example, when "WAYS BET3" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. When the scroll of the symbol arrays on the video reels 3 (REEL1, REEL2, REEL3, REEL4, and REEL5) is stopped and the "7" symbol occurs in the lower stage of the first column area, the upper stage of the second column area, and the middle stage of the third column area, there is a win in which the "7" symbol occurs in three linked positions from the first column area to the third column area (3Kind combination of "7" is formed). In this case, the symbol combination table shown in FIG. 7 is referred to, and the payout amount of coins is determined as "50". Based on the determined payout amount of coins, a payout is awarded.

In the slot game, a bet amount required for one selection of each of five-staged WAYS BET is set as follows: 2 coins for WAYS BET1, 3 coins for WAYS BET2, 7 coins for WAYS BET3, 15 coins for WAYS BET4, and 25 coins for WAYS BET5.

WAYS BET may be selected plural times in a unit game. For example, when WAYS BET3 (7 coins) is selected three times, the total bet amount is 21 coins (7×3=21). When 3Kind of "7" is achieved, the payout amount of coins is 150 coins (50×3=150).

[Contents of Program] The program of the slot game executed by the smartphone 1 will be described with reference to FIG. 8 to FIG. 10.

Normal Slot Game Control Process

Figure 8:
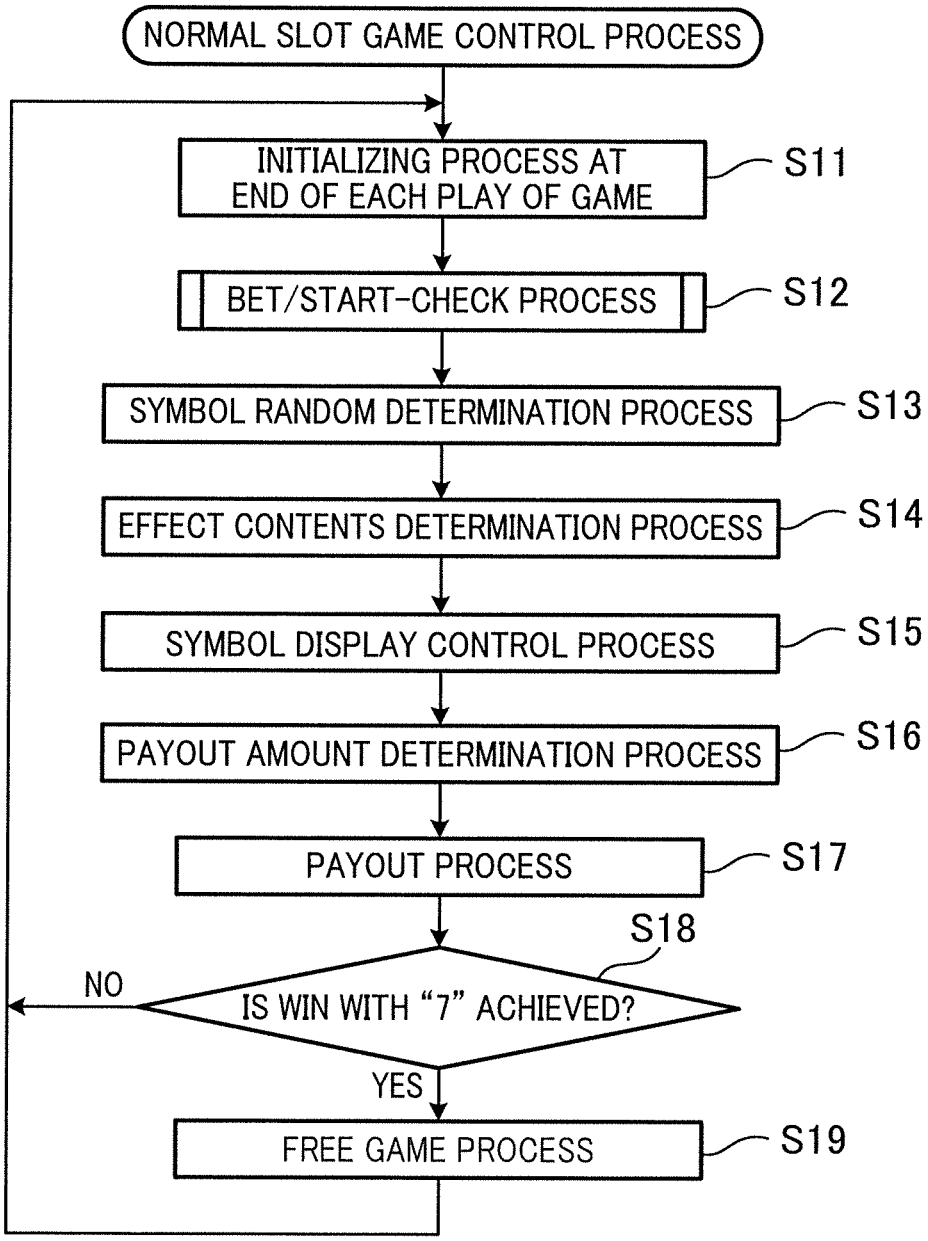
FIG. 8 shows a flowchart of a normal slot game control process.
Figure 9:
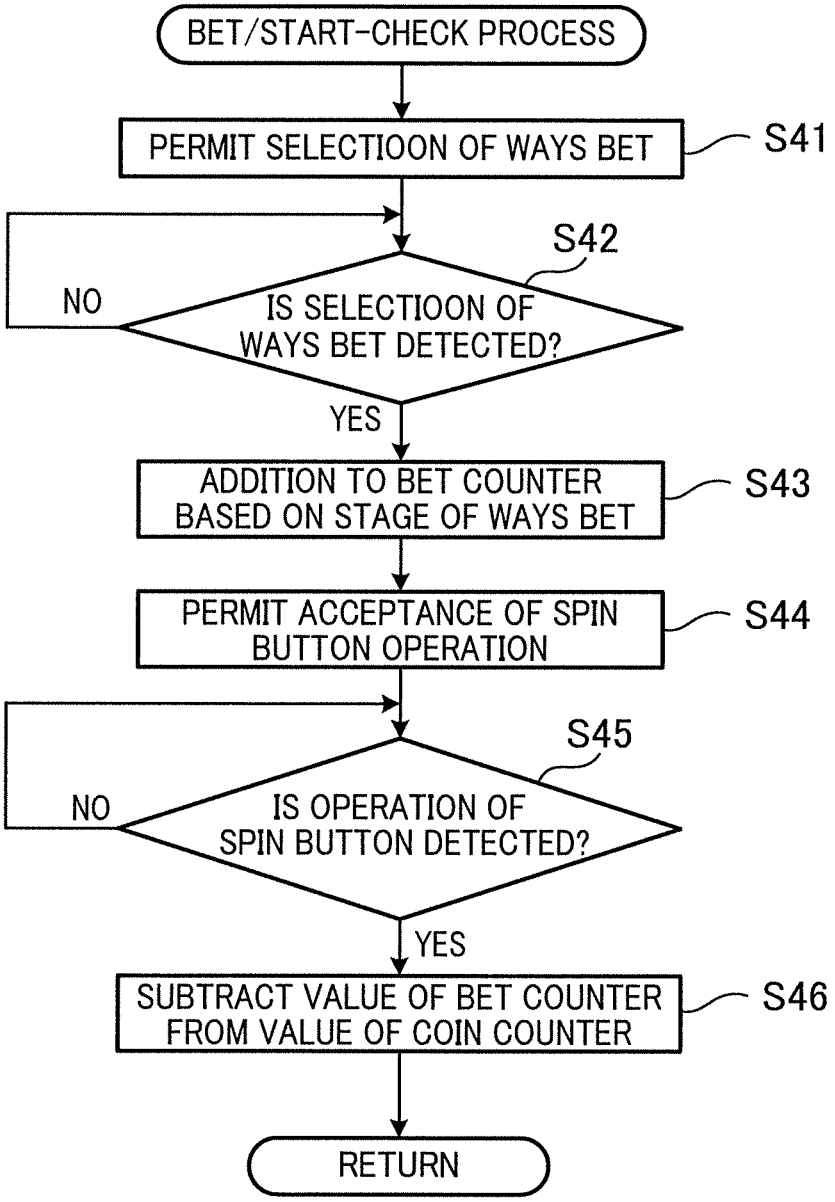
FIG. 9 shows a flowchart of a bet/start-check process.

Referring to FIG. 8, a normal slot game control process will be described. When the slot game starts in the application software, the normal slot game control process is executed if no item is used.

To begin with, the CPU 101 executes an initializing process at the end of each play of the game, in order to start the slot game (S11). For example, this process clears data in a working area of the flash memory 104, which becomes unnecessary at the end of each play of the unit game, e.g., WAYS BET activated in the previous execution of the unit game and symbols to be displayed on the symbol display area 21 as a result of random determination.

The CPU 101 then executes a later-described bet/start-check process (S12). In this process, the CPU 101 checks an input such as WAYS BET (WAYS BET1, WAYS BET2, WAYS BET3, WAYS BET4, or WAYS BET5) selected by using the touch panel 5, etc. At this stage, as shown in FIG. 4, an area which is selected as a subject of result determination in the symbol display area 21 on account of the selection of WAYS BET is shown in white, in order to differentiate such an area from areas (shown in black) which are not subjects of result determination. This makes it possible to visually discern an area which is a subject of result determination from an area which is not a subject of result determination.

Subsequently, the CPU 101 executes a symbol random determination process (S13). In this symbol random determination process, by using the symbol arrays of the video reels 3 shown in FIG. 6, to-be-stopped symbols are randomly selected from symbols provided on the symbol arrays (REEL1, REEL2, REEL3, REEL4, and REEL5) of the video reels. The to-be-stopped symbols are data of 5 symbols displayed in the middle stages of the first column area to the fifth column area of the symbol display area 21, among the symbols constituting the symbol arrays of the video reels 3. In this way, 15 symbols displayed in the symbol display area 21 are determined.

For example, in case of REEL1 of the video reels 3, when a code number "21" is randomly selected from 26 symbols (code numbers "0" to "25") constituting the symbol array, the "CHERRY" symbol corresponding to the code number "21" is selected as the to-be-stopped symbol. In case of the REEL2, when a code number "10" is randomly selected from 29 symbols (code numbers "0" to "28") constituting the symbol array, the "9" symbol corresponding to the code number "10" is selected as the to-be-stopped symbol. In case of the REEL3, when a code number "8" is randomly selected from 28 symbols (code numbers "0" to "27") constituting the symbol array, the "CHERRY" symbol corresponding to the code number "8" is selected as the to-be-stopped symbol. In case of the REEL4, when a code number "7" is randomly selected from 27 symbols (code numbers "0" to "26") constituting the symbol array, the "J" symbol corresponding to the code number "7" is selected as the to-be-stopped symbol. In case of the REEL5, when a code number "6" is randomly selected from 34 symbols (code numbers "0" to "33") constituting the symbol array, the "Q" symbol corresponding to the code number "6" is selected as the to-be-stopped symbol.

The CPU 101 then stores the determined five to-be-stopped symbols in a symbol storing area in the flash memory 104.

Subsequently, the CPU 101 executes an effect contents determination process (S14). The CPU 101 samples an effect-use random number and randomly selects any of a plurality of predetermined effect contents.

Then, the CPU 101 executes a symbol display control process (S15). In this symbol display control process, the scroll of the symbol arrays of the video reels 3 starts. After a predetermined time elapses, the five to-be-stopped symbols selected in the symbol random determination process in S14 stop one by one in the middle stages of the first column area to the fifth column area of the symbol display area 21. In other words, 15 symbols including the to-be-stopped symbols are rearranged in the symbol display area 21. For example, as described above, when the "CHERRY" symbol is selected as a to-be-stopped symbol in the REEL1, the "9" symbol is selected as a to-be-stopped symbol in the REEL2, the "CHERRY" symbol is selected as a to-be-stopped symbol in the REEL3, the "J" symbol is selected as a to-be-stopped symbol in the REEL4, and the "Q" symbol is selected as a to-be-stopped symbol in the REEL5, the symbols "CHERRY", "9", "CHERRY", "J", and "Q" are provided in the middle stages of the first column area to the fifth column area of the symbol display area 21. In each of the upper stages and the lower stages of the first column area to the fifth column area of the symbol display area 21, a symbol having code number which is one number ahead of or behind the to-be-stopped symbol is rearranged (see FIG. 13).

Subsequently, the CPU 101 executes a payout amount determination process (S16). In this process, based on the symbol combination table (see FIG. 7) of the slot game stored in the flash memory 104, whether a win is achieved is determined based on whether the symbols rearranged in the symbol display area 21 form a predetermined number of linked symbols from the first column area to the fifth column area in the areas which are selected as subjects of result determination in the WAYS BET above. In accordance with the type of win, a benefit will be given in the form of awarding a payout and the like. The payout awarded is stored in a payout amount storage area of the flash memory 104.

For example, when "WAYS BET3" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area.

Figure 13:
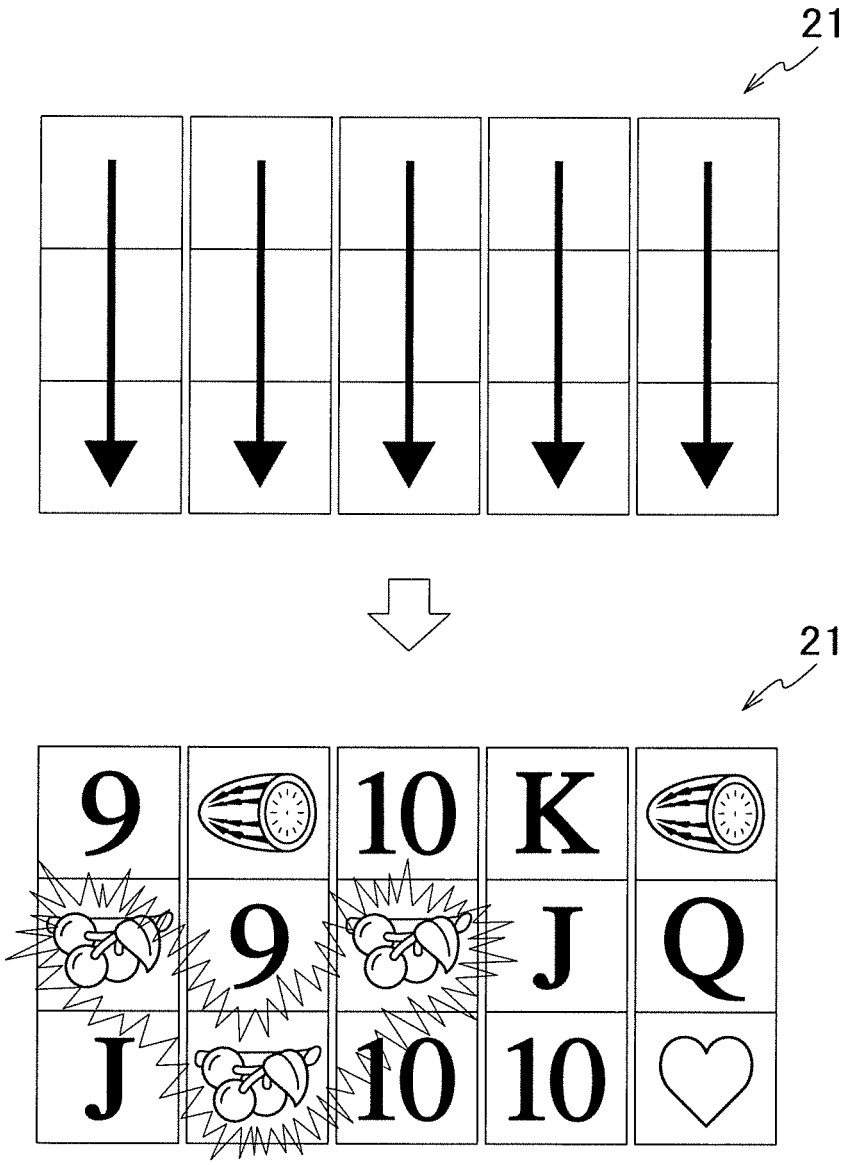
FIG. 13 illustrates the slot game displayed on the display.

As shown in FIG. 13, when "CHERRY" symbols stop in the middle stage of the first column area, the lower stage of the second column area, and the middle stage of the third column area, there is a single win in which the three symbols are successively linked from the first column area to the third column area (LEFT TO RIGHT). In order to visually show the establishment of 3Kind of "CHERRY", the three "CHERRY" symbols emit light and then flicker, as shown in FIG. 13. For the 3Kind of "CHERRY", the symbol combination table shown in FIG. 7 is referred to, and a payout is determined as "15" coins and this payout amount is stored in the payout amount storage area in the flash memory 104.

Subsequently, the CPU 101 executes a payout process (S17). The CPU 101 adds a value stored in the payout amount storage area to the value of a coin counter provided in the flash memory 104. For example, when "15" is stored in the payout amount storage area in the payout amount determination process in S16, "15" is added to the value of the coin counter.

Subsequently, the CPU 101 determines whether a win with "7" (3Kinds of "7", 4Kind of "7", or 5Kind of "7") is achieved (S18). When a win with "7" is achieved (YES in S18), the CPU 101 executes a free game process (S19). This free game process allows the player to play the slot game 20 times without the consumption of coins.

If a win with "7" is not achieved (NO in S18) or after S19, the routine proceeds to S11.

Bet/Start-Check Process

Now, the bet/start-check process will be described with reference to FIG. 9.

To begin with, the CPU 101 permits acceptance of selection of 5-staged WAYS BET (WAYS BET1, WAYS BET2, WAYS BET3, WAYS BET4, and WAYS BET5) by the pressing of the "+" or "−" button (see FIG. 1) of the bet button 244 of the operation display area 24 through the touch panel 5 (S41). As a result of selection of any of the five stages of WAYS BET, an area to be subjected to result determination is selected out of 15 areas of the 5 by 3 matrix of the symbol display area 21 (see FIG. 4).

Subsequently, the CPU 101 determines whether a selection operation (pressing) of the 5-staged WAYS BET (WAYS BET1, WAYS BET2, WAYS BET3, WAYS BET4, and WAYS BET5) is detected (S42). When a selection operation of the WAYS BET is not detected (NO in S42), a selection operation is waited for.

Meanwhile, when a selection operation of WAYS BET (WAYS BET1, WAYS BET2, WAYS BET3, WAYS BET4, and WAYS BET5) is detected (YES in S42), the CPU 101 adds, to the value of the bet counter in the flash memory 104, coins necessary for the WAYS BET (2 coins in case of WAYS BET1, 3 coins in case of WAYS BET2, 7 coins in case of WAYS BET3, 15 coins in case of WAYS BET4, or 25 coins in case of WAYS BET5) (S43).

Subsequently, after S43, the CPU 101 allows the spin button 241 to accept an operation (S44).

After S44, the CPU 101 determines whether or not an operation of the spin button 241 is detected (S45). When the CPU 101 determines that an operation of the spin button 241 is not detected (NO in S45), an operation of the spin button 241 is waited for.

Meanwhile, when the CPU 101 determines that an operation of the spin button 241 is detected (YES in S45), the CPU 101 subtracts the value of the bet counter calculated in S43 from the value of the coin counter (S46). Then the bet/start check process is terminated.

Improved Winning Probability Slot Game Control Process

An improved winning probability slot game control process will be described with reference to FIG. 10. When the slot game starts in the application software, the improved winning probability slot game control process is executed if a predetermined item is used. For example, in the present embodiment, an item "BIG WIN Winning Probability Tripled 100 Rotations" or an item "MEGA WIN Winning Probability Doubled 90 Rotations" is used.

Figure 11:
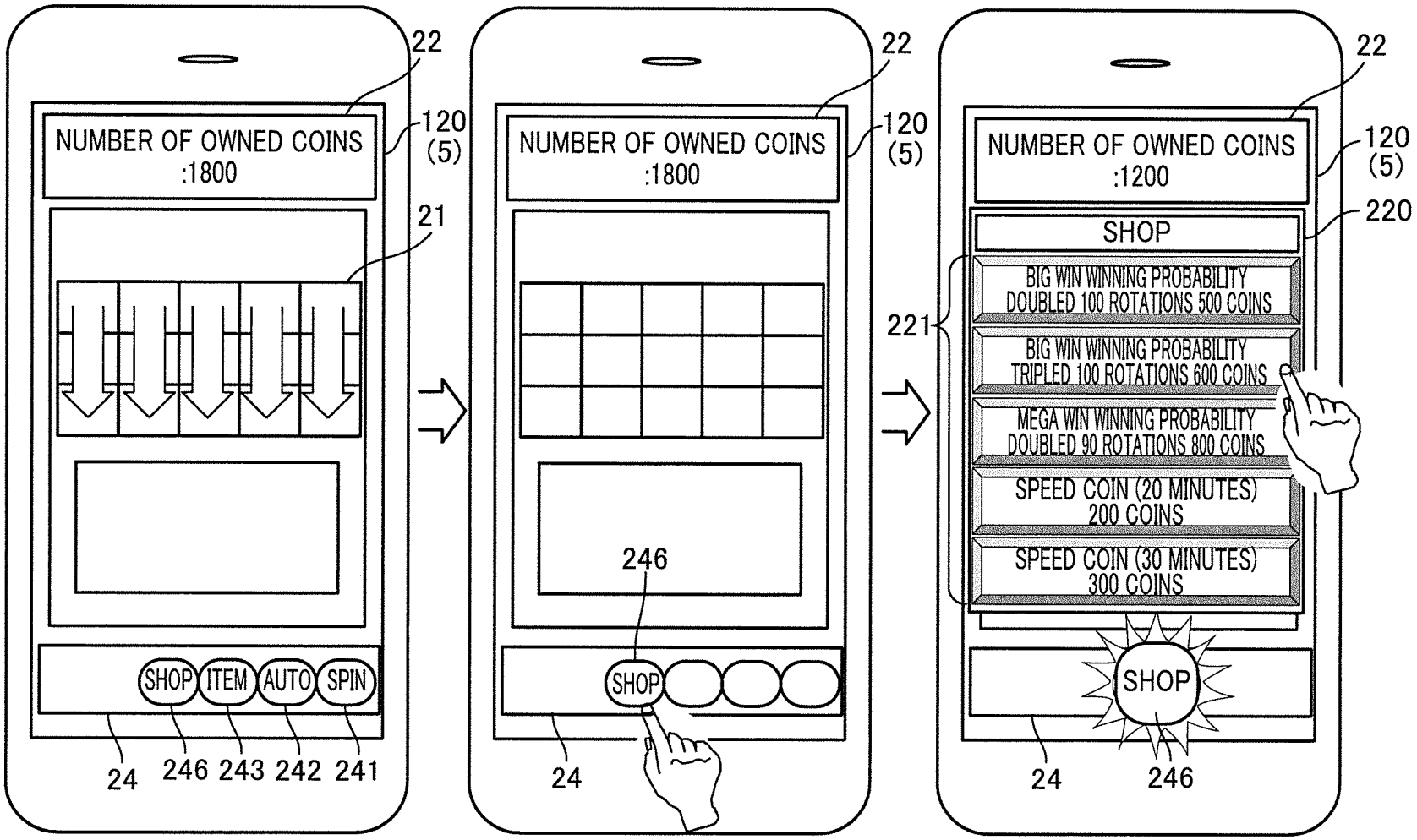
FIG. 11 illustrates a shop screen displayed on a display.

Before describing the improved winning probability slot game control process, how an item is obtained in the slot game of the present embodiment will be briefly described. In the slot game of the present embodiment, various items can be obtained in the advancement of the slot game, as a benefit awarded as a result of the slot game, or in exchange for coins in a shop. For example, as shown in FIG. 11, after the end of the unit game in the slot game, etc., the player is allowed to touch an image of a shop button 246 in the operation display area 24 to display a shop window 220 in which exchange to various items can be done. In the shop window 220, as shown in FIG. 11, icons 221 each associated with the number of coins required to exchange for an item are displayed. The player is allowed to select any of the displayed icons 221 to exchange the owned coins for a desired item. For example, as shown in FIG. 11, when the icon 221 corresponding to the item "BIG WIN Winning Probability Tripled 100 Rotations" is selected from the icons 221, 600 coins are subtracted from the owned coins and the item "BIG WIN Winning Probability Tripled 100 Rotations" is obtained.

Figure 12:
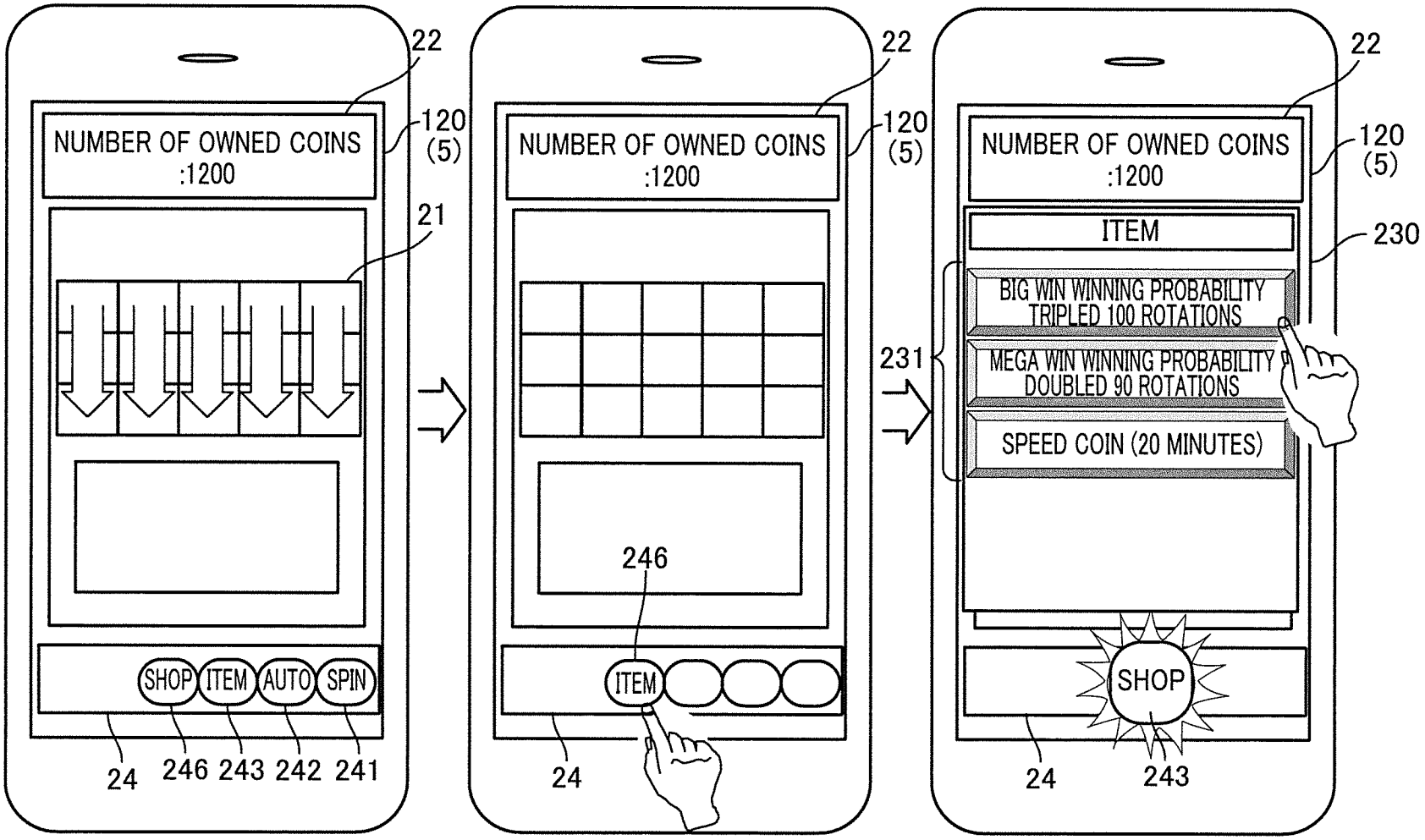
FIG. 12 illustrates how items displayed on the display are used.

The following will describe how items are used in the slot game of the present embodiment. In the present embodiment, for example, as shown in FIG. 12, after the end of the unit game in the slot game, etc., the player is allowed to touch an image of an ITEM button 243 in the operation display area 24 to display an item window 230 in which items owned by the player are displayed for selection. In the item window 230, as shown in FIG. 12, item icons 231 owned by the player are displayed. The player is allowed to select any of the item icons 231 to be used. For example, as shown in FIG. 12, when the item icon 231 corresponding to the item "BIG WIN Winning Probability Tripled 100 Rotations" is selected from the item icons 231, an effect of the use of the item "BIG WIN Winning Probability Tripled 100 Rotations" is exerted.

In regard to the improved winning probability slot game control process of the present embodiment, a case where the item "BIG WIN Winning Probability Tripled 100 Rotations" is used will be described.

Figure 10:
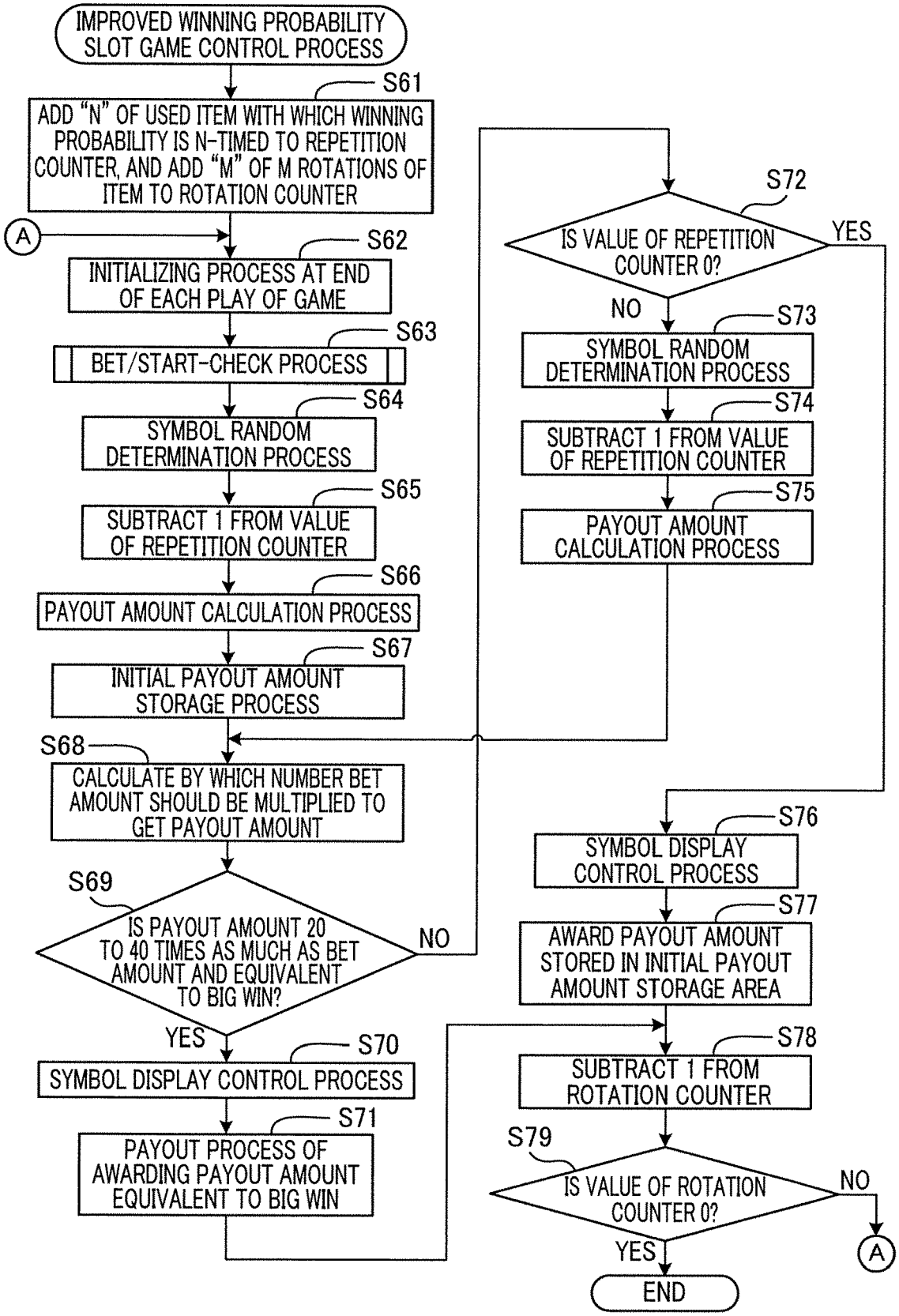
FIG. 10 shows a flowchart of an improved winning probability slot game control process.

As shown in FIG. 10, when the item "BIG WIN Winning Probability Tripled 100 Rotations" is used, the routine shifts to the improved winning probability slot game control process.

The shift to the improved winning probability slot game control process occurs, for example, when specific symbols (e.g., 4Kinds or more of "7") are rearranged as a combination in the normal slot game control process, when specific symbols specified by the game provider are rearranged in combination, or when a predetermine amount of money is paid.

When the improved winning probability slot game control process is executed, to begin with, the CPU 101 adds a value "3" which indicates that the winning probability is tripled in the "BIG WIN Winning Probability Tripled 100 Rotations" to a repetition counter of the flash memory 104 (S61). Furthermore, the CPU 101 adds a value "100" which indicates the 100 rotations in the "BIG WIN Winning Probability Tripled 100 Rotations" to a rotation counter of the flash memory 104 (S61).

Subsequently, the CPU 101 executes an initializing process at the end of each play of the game, in order to start the slot game with the item (S62). For example, this process clears data in a working area of the flash memory 104, which becomes unnecessary at the end of each play of the unit game, e.g., WAYS BET activated in the previous execution of the unit game and symbols to be displayed on the symbol display area 21 as a result of random determination.

The CPU 101 then executes the above-described bet/start-check process (S63). In this process, the CPU 101 checks an input such as WAYS BET (WAYS BET1, WAYS BET2, WAYS BET3, WAYS BET4, or WAYS BET5) selected by using the touch panel 5, etc. At this stage, as shown in FIG. 4, an area which is selected as a subject of result determination in the symbol display area 21 on account of the selection of WAYS BET is shown in white, in order to differentiate such an area from areas (shown in black) which are not subjects of result determination. This makes it possible to visually discern an area which is a subject of result determination from an area which is not a subject of result determination.

Subsequently, the CPU 101 executes a symbol random determination process (S64). In this symbol random determination process, by using the symbol arrays of the video reels 3 shown in FIG. 6, to-be-stopped symbols are randomly selected from symbols provided on the symbol arrays (REEL1, REEL2, REEL3, REEL4, and REEL5) of the video reels. The to-be-stopped symbols are data of 5 symbols displayed in the middle stages of the first column area to the fifth column area of the symbol display area 21, among the symbols constituting the symbol arrays of the video reels 3. In this way, 15 symbols to be displayed in the symbol display area 21 are determined.

Subsequently, the CPU 101 subtracts 1 from the value of the repetition counter of the flash memory 104 (S65).

The CPU 101 then executes a payout amount calculation process (S66). In this process, based on the symbol combination table (see FIG. 7) stored in the flash memory 104, whether a win is achieved is determined based on 15 symbols to be displayed in the symbol display area 21, when the symbols form a predetermined number of linked symbols from the first column area to the fifth column area in the areas which are selected as subjects of result determination in the WAYS BET above. When a win is achieved, a payout corresponding to the achieved win is calculated. The CPU 101 stores the payout calculated in the payout amount calculation process in a payout amount storage area of the flash memory 104. When no win is achieved and no payout is awarded, the payout is "0".

Furthermore, the CPU 101 stores the payout calculated in the payout amount calculation process in an initial payout amount storage area of the flash memory 104, too (S67: initial payout amount storage process).

Subsequently, the CPU 101 calculates by which number the value of the bet counter of the flash memory 104 should be multiplied to get the payout calculated in the payout amount calculation process (S66 or later-described S75) (S68). For example, when the payout calculated in the payout amount calculation process is 500 and the value of the bet counter is 25, the number is 20.

Subsequently, the CPU 101 determines whether the value calculated in S68 is 20 to 40 times as much as the value of the bet counter (i.e., equivalent to BIG WIN) (S69). In the present embodiment, when the payout calculated in the payout amount calculation process is 20 to 40 times as much as the value of the bet counter, the payout is considered as BIG WIN. For example, when the payout calculated in the payout amount calculation process is 500 and the value of the bet counter is 25, the number is 20. This number falls within the range of 20 to 40, and hence the payout is considered as BIG WIN.

When the CPU 101 determines that the payout calculated in the payout amount calculation process is 20 to 40 times as much as the value of the bet counter (equivalent to BIG WIN) (YES in S69), the CPU 101 executes a symbol display control process (S70). In this symbol display control process, the scroll of the symbol arrays of the video reels 3 starts. After a predetermined time elapses, the five to-be-stopped symbols selected in the symbol random determination process in S64 or a later-described symbol random determination process in S73 (i.e., five to-be-stopped symbols constituting a win equivalent to BIG WIN) stop one by one in the middle stages of the first column area to the fifth column area of the symbol display area 21. In other words, 15 symbols including the to-be-stopped symbols are rearranged in the symbol display area 21. In this way, 15 symbols constituting the win equivalent to BIG WIN are displayed in the symbol display area 21.

The CPU 101 then executes a payout process of awarding a payout amount corresponding to the BIG WIN (S71). To be more specific, the CPU 101 adds the value stored in the payout amount storage area to the value of a coin counter of flash memory 104. For example, when "500" is stored in the payout amount storage area in the payout amount calculation process in S66, "500" is added to the value of the coin counter.

Subsequently, the CPU 101 determines whether the value of the repetition counter in the flash memory 104 is 0 (S72) when in S69 the CPU 101 determines that the payout calculated in the payout amount calculation process does not fall within the range of 20 to 40 times as much as the value of the bet counter (i.e., equivalent to BIG WIN) (NO in S69).

When the value of the repetition counter is not 0 (NO in S72), the CPU 101 executes a symbol random determination process (S73). In this symbol random determination process, in the same manner as in S64, by using the symbol arrays of the video reels 3 shown in FIG. 6, to-be-stopped symbols are randomly selected from the symbols on the symbol arrays (REEL1, REEL2, REEL3, REEL4, and REEL5) of the video reels 3. In this way, 15 symbols to be displayed in the symbol display area 21 are determined.

Subsequently, the CPU 101 subtracts 1 from the value of the repetition counter of the flash memory 104 (S74).

The CPU 101 then executes a payout amount calculation process (S75). In this process, in the same manner as in S66, based on the symbol combination table (see FIG. 7) stored in the flash memory 104, whether a win is achieved is determined based on 15 symbols to be displayed in the symbol display area 21, when the symbols form a predetermined number of linked symbols from the first column area to the fifth column area in the areas which are selected as subjects of result determination in the WAYS BET above.

Then a payout corresponding to the achieved win is calculated. The CPU 101 stores the payout calculated in the payout amount calculation process in a payout amount storage area of the flash memory 104. Subsequently, in S68, the CPU 101 calculates by which number the value of the bet counter of the flash memory 104 should be multiplied to get the payout calculated in the payout amount calculation process (75).

Meanwhile, when the value of the repetition counter is 0 in S72 (YES in S72), the CPU 101 executes a symbol display control process (S76). In this symbol display control process, the scroll of the symbol arrays of the video reels 3 starts. After a predetermined time elapses, the five to-be-stopped symbols selected in the symbol random determination process in S64 stop one by one in the middle stages of the first column area to the fifth column area of the symbol display area 21. In other words, 15 symbols including the to-be-stopped symbols are rearranged in the symbol display area 21.

The CPU 101 then adds a value stored in the initial payout amount storage area of the flash memory 104 to the value of the coin counter provided in the flash memory 104 (S77). For example, when "50" is stored in the initial payout amount storage area in the initial payout amount storage process in S67, "50" is added to the value of the coin counter.

After S71 or S77, the CPU 101 subtracts 1 from the value of the rotation counter of the flash memory 104 (S78). To put it differently, the unit game is temporarily terminated.

The CPU 101 then determines whether the value of the rotation counter is 0 (S79). When the value of the rotation counter is not 0 (NO in S79), the process proceeds to S62. When the value of the rotation counter is 0 (YES in S79), the process is terminated.

In the improved winning probability slot game control process, (a) a process of accepting a bet amount by the betting device is executed in S63. Furthermore, (b) a process of performing the random determination based on the bet amount operation in the process (a) is executed in the symbol random determination process in S64. Furthermore, (c) when there is a payout as a result of the random determination in the process (b), a process of calculating the ratio of the payout to the bet amount is executed in S68. Furthermore, (d) a process of determining whether the ratio calculated in the process (c) falls within a predetermined range is executed in S69. When the result is YES in S69, the payout is awarded in S71. Thereafter, the unit game is terminated in S78. As such, (e) a process of awarding the payout and terminating the unit game when the ratio falls within the predetermined range in the process (d) is executed. When the result is NO in S69, the following process is executed in S73 to S75 and subsequent S68 to S71: (f) a process of executing the processes (b) to (e) again when the ratio does not fall within the predetermined range in the process (d) or when there is no payout in the process (b).

According to the arrangement above, when the ratio of the payout calculated in the payout amount calculation process to the bet amount which is the value of the bet counter (i.e., the payout calculated in the payout amount calculation process/the value of the bet counter) falls within the range of 20 to 40 times (predetermined range), a payout is awarded. Meanwhile, when the ratio does not fall within the range of 20 to 40 times or there is no payout, the symbol random determination process (S73) is executed again. With this arrangement, while the probability of awarding a payout is increased by executing the symbol random determination process (S73) again, a payout is awarded only when the ratio of the payout calculated in the payout amount calculation process to the bet amount which is the value of the bet counter falls within the range of 20 to 40 times. For this reason, the payout amount to be awarded does not become excessively large, with the result that disadvantage on the game provider is reduced.

In the present embodiment, when the item "BIG WIN Winning Probability Tripled 100 Rotations" is used (the predetermined condition is satisfied), the value 3 which indicates that the winning probability is tripled is added to the repetition counter of the flash memory 104 (S61). On this account, as the processes S73 to S75 and the subsequent processes S68 to S71 are repeated, (f) the process of executing the processes (b) to (e) again when the ratio does not fall within the predetermined range in the process (d) or when there is no payout in the process (b) is executed twice at the maximum. On this account, the symbol random determination process in S64 and the symbol random determination process in S73 can be executed three times in total at the maximum. (When the winning probability is N-timed, the symbol random determination process in S64 and the symbol random determination process in S73 can be executed N times at the maximum.)

According to the arrangement above, the symbol random determination process (S64 and S73) can be executed N times at the maximum, when the winning probability in the item used is N-timed (N is an integer such as 2, 3, and 4). On this account, the payout rates of the entire game is easily adjustable in the improved winning probability slot game control process which is advantageous for the player.

In the present embodiment, only when a predetermined condition is satisfied, e.g., when the item "BIG WIN Winning Probability Tripled 100 Rotations" is used, when specific symbols (4Kinds or more of "7) are rearranged in combination in the normal slot game control process, when specific symbols specified by the game provider are rearranged in combination in the normal slot game control process, or when a predetermine amount of money is paid, the shift to the improved winning probability slot game control process occurs and the symbol random determination process (S73) can be executed again with an N-timed winning probability (N is an integer such as 2, 3, and 4). On this account, the payout rates of the entire game is easily adjustable in the improved winning probability slot game control process which is advantageous for the player.

In the present embodiment, when a payout equivalent to BIG WIN is not awarded and the value of the repetition counter is 0 (YES in S72), the value stored in the initial payout amount storage area in the initial payout amount storage process in S67 is added to the value of the coin counter (S77). Assume that a payout equivalent to BIG WIN is not awarded even though the symbol random determination process is repeated. Such a case is disadvantageous for the player, because no payout is awarded even though a payout is achieved in the initial symbol random determination process (S64). For this reason, at least the payout achieved the initial symbol random determination process is awarded (guaranteed). With this arrangement, it is possible to avoid excessive disadvantage for the player.

Other Embodiments

While in the present embodiment the smartphone 1 shown in FIG. 1 is taken as an example of the information processor, the information processor of the present invention may be a server or a combination of a server and a mobile information device such as a smartphone which accesses to the server. In this case, the slot game is embodied as a social game. To be more specific, the application software of the slot game is executed on a web browser provided by a server, and the slot game is run in such a way that a mobile information device such a smartphone accesses to the web browser provided by the server.

Therefore, in the slot game, a touch input to a game screen displayed on a display of a mobile information device such as a smartphone is received by a web browser provided by a server. (Receiving of an input signal by the server is equivalent to the betting device.) The server executes the programmed processes (the normal slot game control process, the bet/start check process, the improved winning probability slot game control process, etc.), and the execution process and the execution result are displayed on the display of the mobile information device such as a smartphone, via the Internet. In this case, a storing process in each process is executed in a storage device of the server.

The item "BIG WIN Winning Probability Tripled 100 Rotations" is used in the improved winning probability slot game control process in the embodiment above. Meanwhile, when the item "MEGA WIN Winning Probability Doubled 90 Rotations" is used, whether the value calculated in S68 is 40 to 100 times as much as the value of the bet counter (i.e., equivalent to MEGA WIN) is determined (S69). When the payout calculated in the payout amount calculation process is 40 to 100 times as much as the value of the bet counter, the payout is considered as MEGA WIN. For example, when the payout calculated in the payout amount calculation process is 1500 and the value of the bet counter is 25, the number is 60. This number falls within the range of 40 to 100, and hence the payout is considered as MEGA WIN.

Similarly, when an item "GIGA WIN Winning Probability Doubled 90 Rotations" is used, whether the value calculated in S68 is more than 100 times as much as the value of the bet counter (i.e., equivalent to GIGA WIN) (S69). When the payout calculated in the payout amount calculation process is more than 100 times as much as the value of the bet counter, the payout is considered as GIGA WIN. For example, when the payout calculated in the payout amount calculation process is 3000 and the value of the bet counter is 25, the number is 120. This number falls within the range of more than 100, and hence the payout is considered as GIGA WIN.

When the item "BIG WIN Winning Probability Doubled 100 Rotations" and the item "MEGA WIN Winning Probability Doubled 90 Rotations" are concurrently used, the item "MEGA WIN" exerts the effect first and the item "BIG WIN" exerts the effect second. The order of items in exertion of effects is determined such that an item with which a large payout may be awarded has a high preference.

To be more specific, when the item "BIG WIN Winning Probability Doubled 100 Rotations" and the item "MEGA WIN Winning Probability Doubled 90 Rotations" are concurrently used, in the improved winning probability slot game control process, the effect of the "MEGA WIN Winning Probability Doubled 90 Rotations" is exerted first, and then whether a payout calculated in the payout amount calculation process falls within the range of 40 to 100 times as much as the value of the bet counter (equivalent to MEGA WIN) is determined in S69 (S69). When a payout equivalent to MEGA WIN is not awarded and a payout equivalent to MEGA WIN is not awarded again in S69 after the symbol random determination process in S73 is executed again, the effect of the item "BIG WIN Winning Probability Tripled 100 Rotations" is exerted.

In other words, the symbol random determination process is executed again, and whether the payout calculated in the payout amount calculation process is 20 to 40 times as much as the value of the bet counter (i.e., equivalent to BIG WIN) is determined in S69 (S69). When a payout equivalent to BIG WIN is not awarded, after the symbol random determination process in S73 is executed again, whether a payout equivalent to BIG WIN is awarded is determined in S69 again. As such, when the item "BIG WIN Winning Probability Doubled 100 Rotations" and the item "MEGA WIN Winning Probability Doubled 90 Rotations" are concurrently used, the item "MEGA WIN Winning Probability Doubled 90 Rotations" with which the possibility of obtaining a large payout is high exerts the effect first, and whether there is a payout equivalent to MEGA WIN is determined first in S69.

When the item "BIG WIN Winning Probability Doubled 100 Rotations" and the item "MEGA WIN Winning Probability Doubled 90 Rotations" are concurrently used and a payout equivalent to MEGA WIN is awarded, the use of the item "BIG WIN Winning Probability Doubled 100 Rotations" is not canceled, and the remaining number of the items is reduced even though the effect of the item is not exerted.

While in the present embodiment above the smartphone 1 shown in FIG. 1 is taken as an example of the information processor, the processes and actions of the smartphone 1 can be interpreted as those of a program or a game control method.

A specific control method is as follows.

A method of controlling a unit game involved with random determination includes the steps of:

(a) accepting, by a betting device, a bet amount required to execute the unit game;

(b) executing the random determination based on the bet amount accepted in the step (a);

(c) when there is a payout as a result of the random determination in the step (b), calculating the ratio of the payout to the bet amount;

(d) determining whether the ratio calculated in the step (c) falls within a predetermined range;

(e) when the ratio falls within the predetermined range in the step (d), awarding the payout and terminating the unit game; and (f) when the ratio does not fall within the predetermined range in the step (d) or when there is no payout in the step (b), executing the steps (b) to (e) again.

A specific program is as follows.

A non-volatile recording medium stores a game program, the game program causing an information processor which executes a unit game involved with random determination to execute the processes of:

(a) accepting, by a betting device, a bet amount required to execute the unit game;

(b) executing the random determination based on the bet amount accepted in the process (a);

(c) when there is a payout as a result of the random determination in the process (b), calculating the ratio of the payout to the bet amount;

(d) determining whether the ratio calculated in the process (c) falls within a predetermined range;

(e) when the ratio falls within the predetermined range in the process (d), awarding the payout and terminating the unit game; and (f) when the ratio does not fall within the predetermined range in the process (d) or when there is no payout in the process (b), executing the processes (b) to (e) again.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

What is claimed is:

1. An information processor which executes a randomly determined unit game, comprising:

a display screen capable of displaying the unit game;

at least one input device capable of inputting a bet amount required to execute the unit game;

a controller including a central processing unit in communication with a non-transitory computer readable medium storing computer executable instructions configured to program the controller to execute the unit game;

wherein, when the computer executable instructions are read by the controller, the controller is caused to execute the processes of:

displaying the unit game on the display screen;

(a) accepting the bet amount by the input device;

(b) executing a random determination based on the bet amount input in the process (a);

(c) when there is a payout as a result of the random determination in the process (b), calculating a ratio of a payout amount to the bet amount;

(d) determining whether the ratio calculated in the process (c) falls within a predetermined range;

(e) when the ratio falls within the predetermined range in the process (d), awarding the payout amount and terminating the unit game; and (f) when the ratio does not fall within the predetermined range in the process (d) or when there is no payout based on the result of the process (b), executing the processes (b) to (e) again.

2. The information processor according to claim 1, wherein, the controller is configured to further execute the process (f) when a predetermined condition is satisfied.

3. The information processor according to claim 1, wherein, when the payout ratio does not fall within the predetermined range and no payout is awarded as a result of the process (f), and there is a payout corresponding to the random determination in the process (b), the controller awards the payout corresponding to the result of the random determination in the process (b).

4. The information processor according to claim 2, wherein, when the payout ratio does not fall within the predetermined range and no payout is awarded as a result of the process (f), and there is a payout corresponding to the random determination in the process (b), the controller awards the payout corresponding to the result of the random determination in the process (b).

5. The information processor of claim 1, comprising a mobile communications device including a touchscreen, a microphone, and an audio output device.

6. The information processor of claim 5, wherein the mobile communications device is in communication with a server, the server transmitting the computer-readable instructions to execute the unit game the mobile communications device.

7. The information processor of claim 6, wherein the unit game comprises a slot-type unit game wherein a plurality of symbols are randomly rearranged and stop displayed to the display screen.

8. The information processor of claim 6, wherein the unit game displayed to the display screen includes a graphical user interface including one or more virtual input buttons allowing input of a bet amount.

9. An information processor which executes a randomly determined unit game, comprising:

a display screen capable of displaying the unit game;

at least one input device capable of inputting a bet amount required to execute the unit game;

a controller including a central processing unit in communication with a non-transitory computer readable medium storing computer executable instructions configured to program the controller to execute the unit game;

wherein, when the computer executable instructions are read by the controller, the controller is caused to execute the processes of:

(a) displaying the unit game on the display screen, the unit game including a rearrangement of a plurality of symbols;

(b) accepting the bet amount by the input device;

(c) executing a random symbol determination based on the bet amount input in the process (b);

(d) when there is a payout as a result of the random symbol determination, calculating a ratio of a payout amount to the bet amount;

(e) determining whether the ratio calculated in the process (d) falls within a predetermined range;

(f) when the ratio falls within the predetermined range in the process (e), awarding the payout amount and terminating subsequent further random symbol determinations in the unit game; and (g) when the ratio does not fall within the predetermined range in the process (e) or when there is no payout based on the result of the process (c), executing the processes (c) to (e) again for a maximum predetermined number of subsequent random symbol determinations in the unit game.

10. The information processor of claim 9, wherein when the ratio does not fall within the predetermined range in the process (e), no payout is awarded.

11. The information processor of claim 9, wherein when the ratio falls within the predetermined range in the process (e), awarding the payout amount, terminating subsequent further random symbol determinations in the unit game, and executing subsequent unit games a predetermined number of times.

12. The information processor of claim 9, wherein the controller is further caused to execute the processes of:

(h) determining whether a predetermined condition that increases a probability (N) of a preset win-type for a predetermined number of unit games (M) is satisfied;

(i) executing a random symbol determination of a unit game based on the bet amount input in the process (b) and the random symbol determination in process (c);

(j) when the predetermined condition that increases the probability (N) of the preset win-type is satisfied in the process (h), increasing the number of random symbol determinations in each unit game in the process (c) by (N) for the predetermined number of unit games (M), and when there is a payout as a result of one of the (N) random determinations in the unit game, calculating a ratio of a payout amount to the bet amount.

13. The information processor of claim 12, wherein when the ratio does not fall within the predetermined range in the process (e) or in any of the (N) random symbol determinations in the unit game no payout amount is awarded in the unit game, and subsequent unit games are executed at the probability (N) a maximum of M times.

14. The information processor of claim 12, wherein when the ratio falls within the predetermined range in the process (e), awarding the payout amount in the unit game, terminating subsequent further random symbol determinations in the unit game, and executing subsequent unit games at the probability (N) a maximum of M times.

* * * * *